US006779868B2

(12) United States Patent
Ho

(10) Patent No.: US 6,779,868 B2
(45) Date of Patent: Aug. 24, 2004

(54) PRINTER WITH A CALIBRATION POSITION POSITIONED WITHIN A PRINTING RANGE

(75) Inventor: Chien-Hsien Ho, I-Lan (TW)

(73) Assignee: BenQ Corporation, Tao-Yuan Hsien (TW)

( * ) Notice: Subject to any disclaimer, the term of this patent is extended or adjusted under 35 U.S.C. 154(b) by 0 days.

(21) Appl. No.: 10/064,255

(22) Filed: Jun. 26, 2002

(65) Prior Publication Data

US 2003/0007032 A1 Jan. 9, 2003

(30) Foreign Application Priority Data

Jul. 6, 2001 (TW) ..... 90116573 A

(51) Int. Cl.[7] ..... B41J 23/00; B41J 29/393; B41J 2/175; B41J 29/38; B41J 2/325

(52) U.S. Cl. ..... 347/37; 347/19; 347/222; 347/5; 347/20

(58) Field of Search ..... 347/5, 20, 19, 347/37, 222

(56) References Cited

U.S. PATENT DOCUMENTS 4,167,013 A * 9/1979 Hoskins et al. ..... 347/37
4,580,150 A * 4/1986 Tazaki ..... 347/43
4,926,196 A * 5/1990 Mizoguchi et al. ..... 347/23
5,075,609 A * 12/1991 Ito et al. ..... 318/696
5,168,291 A * 12/1992 Hiramatsu et al. ..... 347/19
5,245,359 A * 9/1993 Ito et al. ..... 346/139 R
5,825,378 A * 10/1998 Beauchamp ..... 347/19
5,825,381 A * 10/1998 Choo ..... 347/37
5,842,800 A * 12/1998 Bailey et al. ..... 400/703
5,953,024 A * 9/1999 Lee et al. ..... 347/23
6,010,206 A * 1/2000 Simons ..... 347/40
6,015,204 A * 1/2000 Ha ..... 347/37
6,164,750 A * 12/2000 Subirada et al. ..... 347/19
6,264,303 B1 * 7/2001 Watanabe ..... 347/37
6,378,977 B1 * 4/2002 Gompertz ..... 347/19
6,412,899 B1 * 7/2002 Choo ..... 347/19
6,419,342 B1 * 7/2002 Bronswijk et al. ..... 347/19
6,431,775 B1 8/2002 Huang et al.
6,435,641 B1 * 8/2002 Tung et al. ..... 347/16
6,499,827 B2 * 12/2002 Elgee ..... 347/37

FOREIGN PATENT DOCUMENTS

TW 311207 7/1997

* cited by examiner

*Primary Examiner*—Stephen D. Meier
*Assistant Examiner*—Leonard S Liang
(74) *Attorney, Agent, or Firm*—Winston Hsu

(57) ABSTRACT

A printer includes a position detecting mechanism for detecting and calibrating a position of a carriage on a track, and a print head installed on the carriage for printing a document. The position detecting mechanism has a first portion installed at a calibration position neighboring the track, and a second portion installed on the carriage. The calibration position is positioned within a document printing range of the print head so that the second portion is capable of passing by the first portion during a printing process.

10 Claims, 6 Drawing Sheets

PRINTER WITH A CALIBRATION POSITION POSITIONED WITHIN A PRINTING RANGE

BACKGROUND OF INVENTION

1. Field of the Invention

The present invention relates to a printer, and more specifically, the present invention discloses a printer that is capable of setting a calibration position within a range in which a print head is able to print a document.

2. Description of the Prior Art

Please refer to FIG. 1. FIG. 1 is a perspective view of a printer 10 disclosed in U.S. Pat. No. 5,861,726. The printer 10 comprises a housing 12, a carriage 14 installed inside the housing 12 that moves in right and left directions on a horizontal track 16, an ink container 18 installed on the carriage 14, a print head 20 set on the ink container 18, and a step motor 30 for driving the carriage 14. The printer 10 further comprises a light source 22, and a light sensor 24 installed outside a printing range of the printer 10. The carriage 14 further comprises a shield 26 for blocking light transmitted from the light source 22 to the light sensor 24.

The step motor 30 drives the carriage 14 to move left and right along the horizontal track 16, so that the print head 20 is able to print the document. Before the printer 10 starts to print the document, the printer 10 calibrates a position of the carriage 14 to a zeroed position, i.e. the position that the light source 22 and the light sensor 24 is at, outside of the printing range. The position of the carriage 14 is calibrated by using the step motor 30 to drive the carriage 14 to move until the shield 26 on the carriage 14 blocks the light transmitted from the light source 22 to the light sensor 24. When starting printing of the document, the step motor 30 drives the carriage 14 to a printing start point, so as to enter the printing range, then prints the document until printing is finished, or the next calibration time, at which time the position of the carriage 14 is zeroed again.

In the prior art printing method, the printer 10 is unable to detect immediately if the position of the print head 20 is not accurate, so the print head 20 continues printing on a wrong position, until the whole document is printed, or the next calibration. This wastes time and ink.

SUMMARY OF INVENTION

It is therefore a primary objective of the claimed invention to provide a printer that is capable of setting the calibration position inside the printing range. While not consuming excess time, the printer is able to detect the position of the print head in the printing process, so as to check whether the position of the print head is correct or not. If the error of the print head position is too large, then the printer is able to stop printing and calibrate the position of the carriage instantly, not wasting printing time and ink.

The claimed invention, briefly summarized, discloses a printer including a position detecting mechanism for detecting and calibrating a position of a carriage on a horizontal track, and a print head installed on the carriage for printing a document. The position detecting mechanism has a first portion installed at a calibration position of the horizontal track, and a second portion installed on the carriage. The calibration position is positioned within a document printing range of the print head, so that the second portion is capable of passing by the first portion during a printing process.

It is an advantage of the claimed invention that the printer has a position detecting mechanism installed within the printing range of the print head, so that the position of the carriage is detected and calibrated in the printing process. If an error of the print head position exceeds a predetermined range, but is within an acceptable range, the printer can calibrate the position of the carriage after printing the document. In contrast, if the position of the print head has a serious misalignment, then the printer may stop printing the document and calibrate the position of the carriage instantly, to avoid wasting printing time and ink.

These and other objectives of the present invention will no doubt become obvious to those of ordinary skill in the art after reading the following detailed description of the preferred embodiment, which is illustrated in the various figures and drawings.

DETAILED DESCRIPTION

Figure 1:
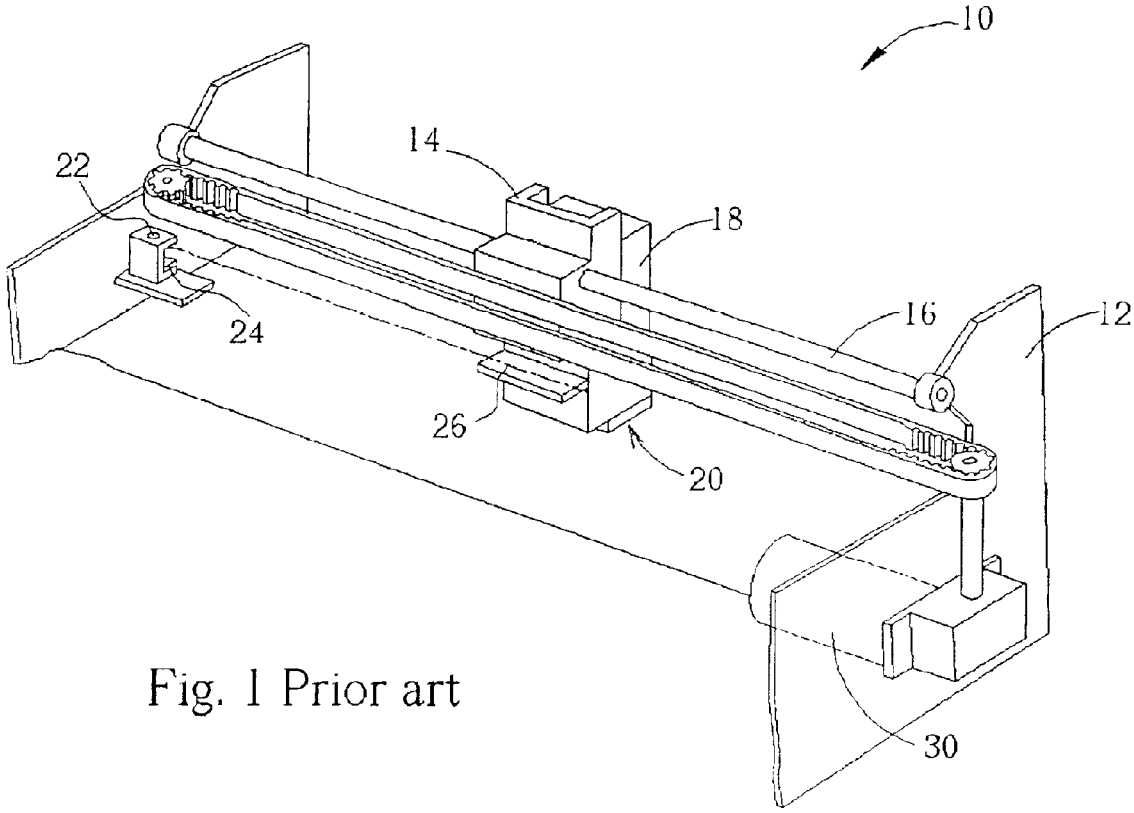
Fig. 1 Prior art
FIG. 1 is a perspective view of a printer according to the prior art.
Figure 2:
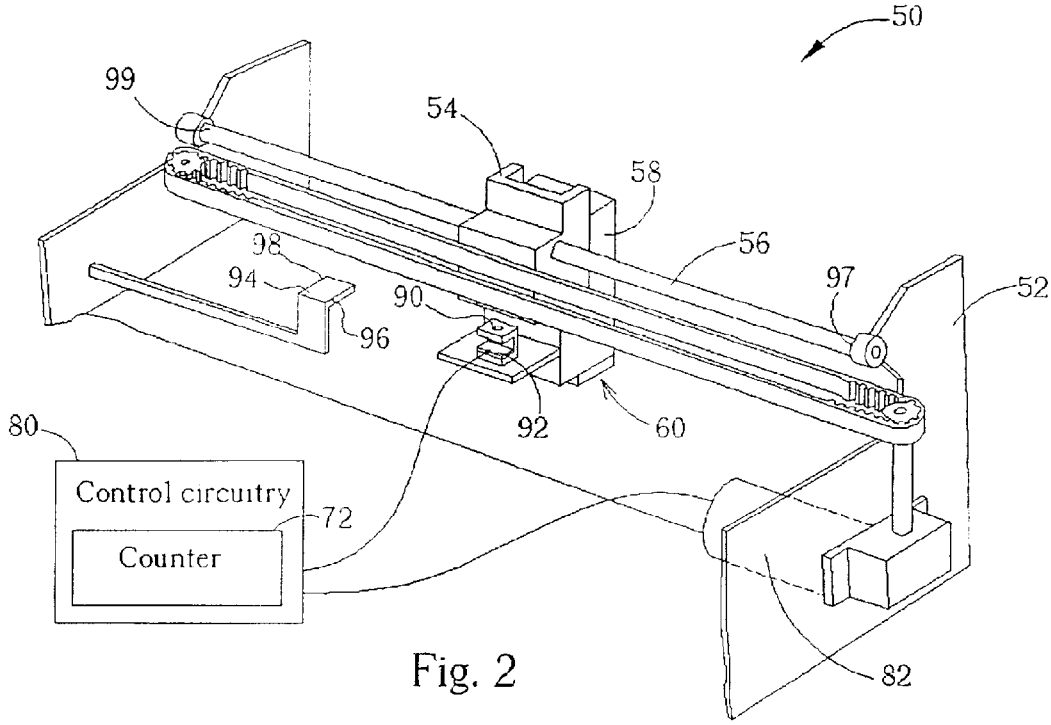
FIG. 2 is a perspective view of a present invention printer.

Please refer to FIG. 2. FIG. 2 is a perspective view of a printer 50 according to the present invention. The printer 50 comprises a housing 52, a carriage 54 installed within the housing 52 that can move back and forth in left and right directions on a horizontal track 56, an ink container 58 installed on the carriage 54, a print head 60 communicated with the ink container 58 for ejecting the ink onto a document while the carriage 54 is moving in left and right directions. The printer 50 further comprises a shield 94 installed on the base of the housing 52 within the printing range in which the print head 60 can print information onto the paper. The shield 94 is used to detect and calibrate the position of the carriage 54. The printer 50 also has control circuitry 80 for controllings operations of the printer 50, and a step motor 82 for driving the carriage 54. The control circuitry 80 comprises a counter 72, which counts rotational steps of the step motor 82 to record the counted position of a light source 90 and a light sensor 92 disposed on the carriage 54.

The shield 94 comprises a first edge 96 and a second edge 98. The control circuitry 80 records positions of the first edge 96 and the second edge 98 of the shield 94 corresponding to the horizontal track 56. The position of the first edge 96 of the shield 94 is corresponding to a first calibration position of the horizontal track 56. The position of the second edge 98 of the shield 94 is corresponding to a second calibration position of the horizontal track 56.

The printing process operated among those components shown in FIG. 2 is further explained below. During movement of the carriage 54 from the end point 97 toward the end point 99 of the horizontal track 56, when the light source 90 and the light sensor 92 move to the first calibration position (first edge 96), the shield 94 starts to block the light transmitted from the light source 90 to the light sensor 92. Then, the control circuitry 80 compares (a) the first counted position of the light source 90 and the light sensor 92 along the horizontal track 56 (the rotational steps of step motor 82 counted by the counter 72), with (b) the first calibration position (the predetermined first rotational step count recorded in the control circuitry 80), to obtain a first difference between the two positions.

When the light source 90 and the light sensor 92 on the carriage 54 move to the second calibration position (second edge 98), the light sensor 92 starts to receive the light transmitted from the light source 90 again. Then, the control circuitry 80 compares (a) the second counted position of the light source 90 and the light sensor 92 along the horizontal track 56 (the rotational steps of step motor 82 counted by the counter 72), with (b) the second calibration position (the predetermined second rotational step count recorded in the control circuitry 80), to obtain a second difference between the two positions.

If (a) the first difference between the first calibration position and the first counted position of the light source 90 and the light sensor 92, or (b) the second difference between the second calibration position and the second counted position of the light source 90 and the light sensor 92 is less than a first predetermined range, then the control circuitry 80 does not need to calibrate the position of the carriage 54. This is because the difference is within a permissible error tolerance.

If (a) the first difference between the first calibration position and the first counted position of the light source 90 and the light sensor 92, or (b) the second difference between the second calibration position and the second counted position of the light source 90 and the light sensor 92 is larger than the first predetermined range but less than the second predetermined range, then the control circuitry 80 calibrates the position of the carriage 54 after the on-going document printing process is completed. The control circuitry 80 need not stop printing and calibrate the position of the carriage 54 immediately. In this situation, there does exist certain minor position error of the carriage 54, but the influence is limited.

Otherwise, if a) the first difference between the first calibration position and the first counted position of the light source 90 and the light sensor 92, or (b) the second difference between the second calibration position and the second counted position of the light source 90 and the light sensor 92 is greater than the second predetermined range, then the control circuitry 80 will instantly stop printing the document and calibrate the position of the carriage 54. In this situation, there does exist serious position error of the carriage 54 to affect the print out quality.

Figure 3:
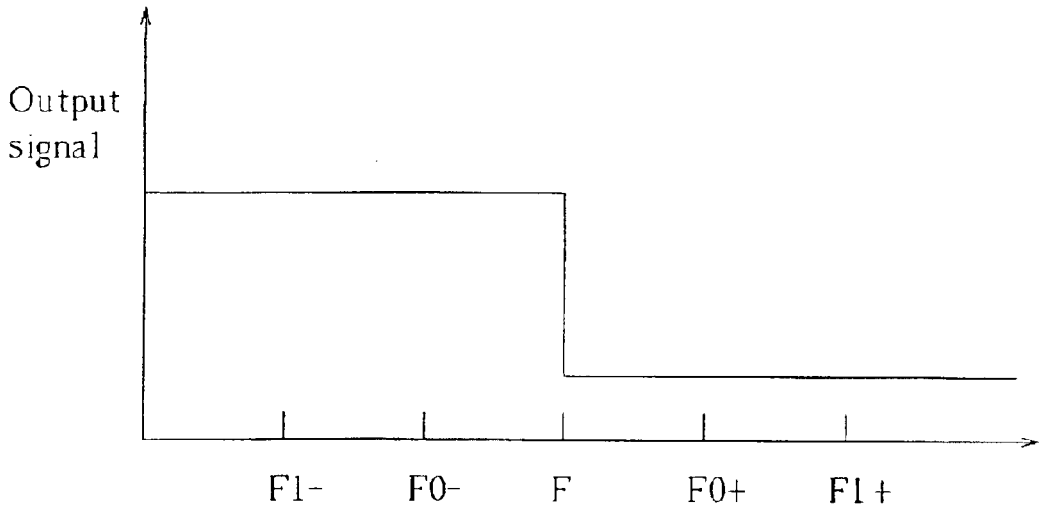
FIG. 3 is a diagram of a relation between an output signal of a light sensor and a position of a light source and the light sensor on a carriage.

Please refer to FIG. 3. FIG. 3 is a diagram of a relation between (a) the output signal of the light sensor 92 and (b) the light source 90 and the light sensor 92 moving along the horizontal track 56. In FIG. 3, F represents the first calibration position corresponding to the first rotational step count recorded in the control circuitry 80. The first predetermined range corresponding to a smaller tolerance around the first calibration position is defined by the area between F0− and F0+. The second predetermined range corresponding to a larger tolerance around the first calibration position is defined by the area between F1− and F1+.

In theory, as shown in FIG. 3, when the light source 90 and light sensor 92 arrive at the position F, then the shield 94 starts to block the light transmitted from the light source 90 to the light sensor 92. Therefore, when the output signal of the light sensor 92 changes from a high voltage to a low voltage, the counted position (the rotational steps counted by the counter 72) should be same as the first calibration position F (the first rotational step count recorded in the control circuitry 80). However, in practice, when the transition of the output signal of the light sensor 92 occurs, the rotational steps counted by the counter 72 does not always equal to the first rotational step count recorded in the control circuitry 80 which represents the first calibration position F.

If the output signal of the light sensor 92 changes when the light source 90 and the light sensor 92 arrive at the range between F0− and F0+, then the control circuitry 80 does not need to calibrate the position of the carriage 54 because the position of the carriage 54 only has a very minor deviation. If the output signal of the light sensor 92 changes when the light source 90 and the light sensor 92 arrive at the range between F1− and F0−, or at the range between F0+ and F1+, then the control circuitry 80 must calibrate the position of the carriage 54 after the on-going document printing process is completed because the deviation is still tolerable for the on-going document. If the output signal of the light sensor 92 changes while the light source 90 and the light sensor 92 have not reached the position F1−, or when the light source 90 and the light sensor 92 have passed the position F1+, then the control circuitry 80 must instantly stop printing the document and calibrate the position of the carriage 54. This is because the position of the carriage 54 has a severe deviation.

A position detection method when the light source 90 and the light sensor 92 on the carriage 54 arrive the second calibration position is similar to the position detection method when the light source 90 and the light sensor 92 on the carriage 54 arrive the first calibration position.

In the present invention, the printer 50 detects the difference between the first and second counted positions of the light source 90 and the light sensor 92 and the first and second calibration positions at the horizontal track 56, recorded by the control circuitry 80. The printer 50 detects the above difference once whenever the light source 90 and the light sensor 92 pass through the first or second calibration position once in either process: (a) the carriage 54 moving from the end point 97 towards the end point 99, or (b) the carriage 54 moving from the end point 99 towards the end point 97.

Moreover, the printer 50 is also capable of detecting the difference between the position of the light source 90 and the light sensor 92, corresponding to the horizontal track 56, and the position which the first or second calibration position at the horizontal track 56, recorded by the control circuitry 80. This difference will be measured when the light source 90 and the light sensor 92 pass through the first or second calibration position.

Figure 4:
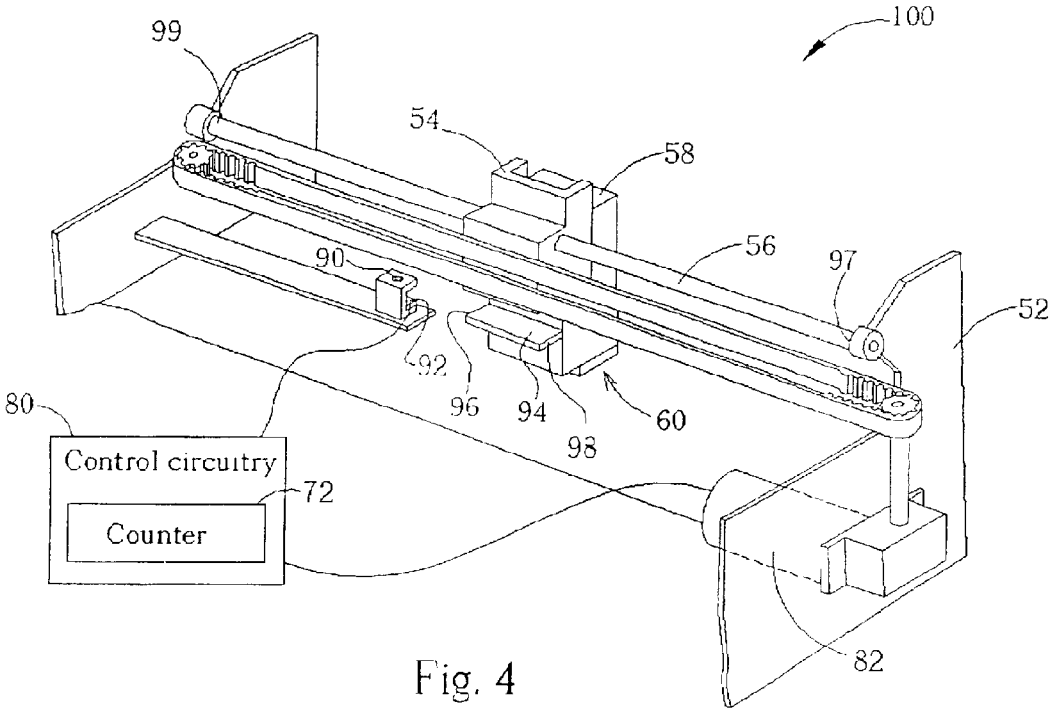
FIG. 4 is a perspective view of a second embodiment of the present invention printer.

Please refer to FIG. 4. FIG. 4 is a perspective view of a second embodiment of a present invention printer 100. The difference between the printer 100 of the second embodiment and the printer 50 of the first embodiment is the shield 94 of the printer 100 is installed on the carriage 54, and the light source 90 and the light sensor 92 of the printer 100 are installed on the housing 52 within a range in which the print head 60 is capable of printing the document. The position of the light source 90 and the light sensor 92 of printer 100 corresponds to the calibration position of the horizontal track 56, for detecting the position of the carriage 54.

In the process of the print head 60 printing the document shown in FIG. 4, the first edge 96 of the shield 94 moves towards the end point 99 of the horizontal track 56 to a position in which the shield 94 starts to block the light transmitted from the light source 90 to the light sensor 92.

When this happens, the control circuitry 80 compares (a) the first counted position of the first edge 96 of the shield 94 represented by the rotational steps counted by the counter 72, with (b) the predetermined calibration position recorded in the control circuitry 80, and obtains a difference between the two positions.

Later, the shield 94 further moves and makes the second edge 98 of the shield 94 move to a position in which the light sensor 92 starts to receive the light transmitted from the light source 90 again. When this occurs, the control circuitry 80 compares (a) the second counted position of the second edge 98 of the shield 94 represented by the rotational steps counted by the counter 72, with (b) the predetermined calibration position recorded in the control circuitry 80, and obtains a difference between the two positions.

If the difference between the counted position of the first edge 96 or the second edge 98 of the shield 94 and the calibration position at the horizontal track 56 exceeds a first predetermined range but within a second predetermined range, then the control circuitry 80 calibrates the position of the carriage 54 after the on-going printing process is completed.

If the difference between the counted position of the first edge 96 or the second edge 98 of the shield 94 and the calibration position at the horizontal track 56 exceeds the second predetermined range, then the control circuitry 80 instantly stops printing the document and calibrates the position of the carriage 54 immediately.

Similarly, the printer 100 detects the above difference once whenever the first edge 96 or the second edge 98 passes through the calibration position once in either process: (a) the carriage 54 moving from the end point 97 towards the end point 99, or (b) the carriage 54 moving from the end point 99 towards the end point 97.

Figure 5:
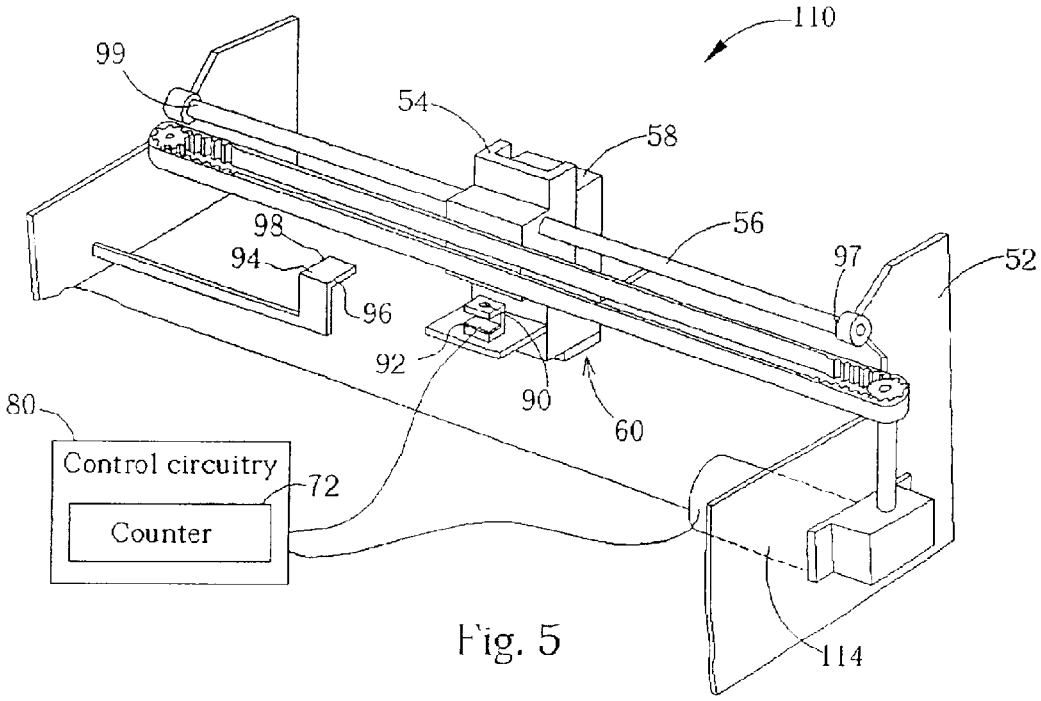
FIG. 5 is a perspective view of a third embodiment of the present invention printer.
Figure 6:
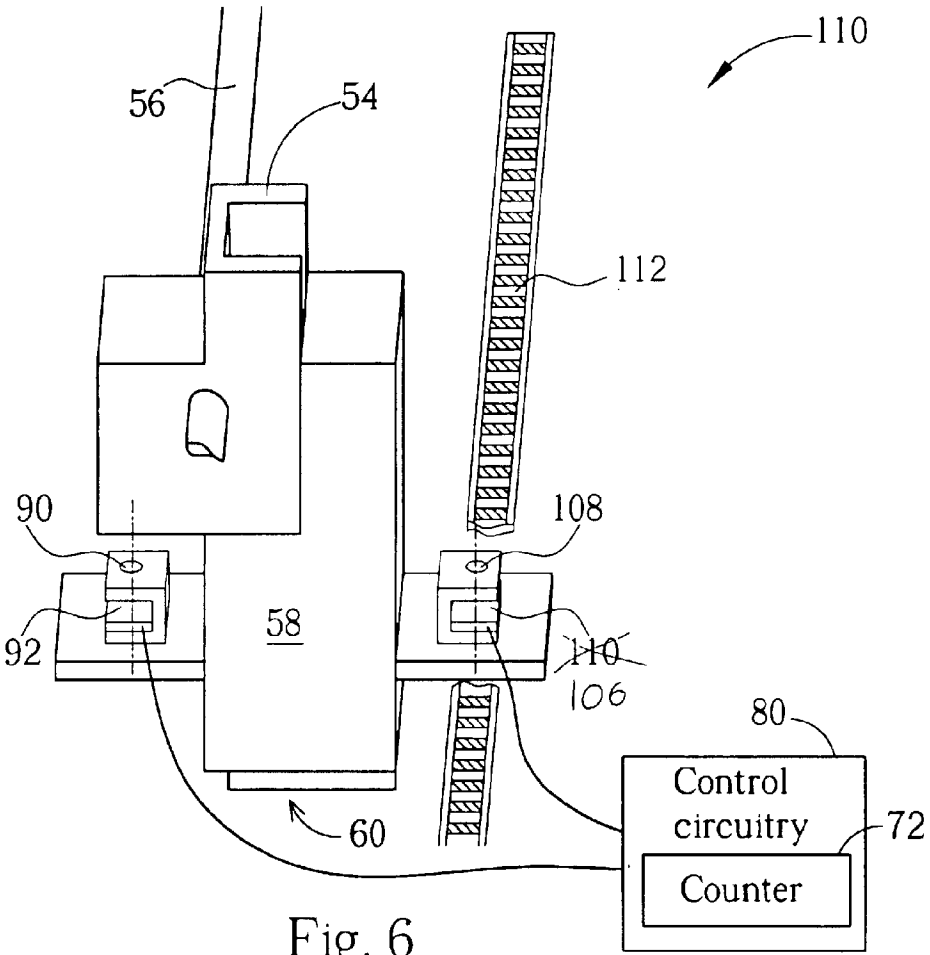
FIG. 6 is another perspective view of the third embodiment of the present invention printer.

Please refer to FIG. 5 and FIG. 6. FIG. 5 and FIG. 6 are perspective views of a third embodiment of a present invention printer 110. The difference between the printer 110 and the printer 50 is the printer 110 uses a DC motor 114 to drive the carriage 54. The printer 110 further comprises an optics ruler 112 installed on the housing 52. The carriage 54 further has a light source 108 installed for transmitting the light towards the optics ruler 112, and a light sensor 106 for detecting the light transmitted from the light source 108 and through the optics ruler 112 and generating the corresponding position signal. The counter 72 is used, according to the position signal generated by the light sensor 106, to indicate the position of the light source 90 and the light sensor 92, corresponding to the horizontal track 56.

Similarly, the printer 110 is also able to use the DC motor 114 to drive the carriage 54. The printer 110 is able to use the optics ruler 112, light source 108, and the light sensor 106 to generate the position signal. Based on the position signal generated from the optical ruler 112, the counter 72 is able to record the first counted position of the first edge 96 or the second counted position of the second edge 98, corresponding to the horizontal track 56.

In contrast to the prior art, the present invention printer is able to stop printing the document and calibrate the position of the carriage instantly when the position of the print head has a serious error, not wasting printing time and ink. If the error of the print head position exceeds a predetermined range but is still tolerable, the printer can calibrate the position of the carriage after printing the document. This avoids wasting the printing document, and ensures the printing quality of the next document.

Those skilled in the art will readily observe that numerous modifications and alterations of the device may be made while retaining the teachings of the invention. Accordingly, the above disclosure should be construed as limited only be the metes and bounds of the appended claims.

What is claimed is:

1. A printer comprising:

a housing;

a track installed within the housing;

a carriage moveably installed on the track;

a print head installed on the carriage for ejecting ink onto a medium;

a position detecting mechanism comprising a first portion installed at a calibration position neighboring the track, and a second portion installed on the carriage; and control circuitry for controlling operations of the printer and recording the calibration position at the track, the control circuitry comprising a counter for recording a counted position of the second portion of the position detecting mechanism;

wherein the calibration position is within a range which the print head is capable of printing the medium, and the second portion is capable of passing by the first portion when the print head simultaneously ejects ink onto the medium;

wherein when printing the medium, if a difference between the position of the second portion corresponding to the track recorded by the counter and the position of the calibration position at the track recorded by the control circuitry is within a first predetermined range, the control circuitry does not need to calibrate the position of the carriage.

2. The printer of claim 1 wherein the second portion comprises a light source and a light sensor installed on the carriage, the first portion comprising a shield installed on the housing for shielding light transmitted from the light source to the light sensor.

3. The printer of claim 2 wherein a first edge of the shield corresponds to a first calibration position; and when the light source and the light sensor on the carriage move to the first calibration position which the shield starts to shield the light transmitted from the light source to the light sensor, the control circuitry will compare the position of the light source and the light sensor corresponding to the track counted by the counter with the first calibration position recorded by the control circuitry to obtain a first difference of the two positions; wherein a second edge of the shield corresponds to a second calibration position; and when the light source and the light sensor on the carriage move to the second calibration position which the light sensor starts to receive the light transmitted from the light source again, the control circuitry will compare the position of the light source and the light sensor corresponding to the track counted by the counter with the second calibration position recorded by the control circuitry to obtain a second difference of the two positions.

4. The printer of claim 1 wherein the first portion comprises a light source and a light sensor installed on the housing, the second portion comprising a shield installed on the carriage for shielding light transmitted from the light source to the light sensor.

5. The printer of claim 4 wherein the light source and the light sensor correspond to the calibration position of the track; and when a first edge of the shield moves to a position which the shield starts to shield the light transmitted from the light source to the light sensor, the control circuitry will compare the position of the first edge of the shield corresponding to the track counted by the counter with the calibration position recorded by the control circuitry to obtain a difference of the two positions.

6. The printer of claim 4 wherein the light source and the light sensor correspond to the calibration position of the track; and when a second edge of the shield moves to a position which the light sensor starts to receive the light transmitted from the light source again, the control circuitry will compare the position of the second edge of the shield corresponding to the track counted by the counter with the calibration position recorded by the control circuitry to obtain a difference of the two positions.

7. The printer of claim 1 wherein when printing the medium, if the difference between the position of the second portion corresponding to the track recorded by the counter and the position of the calibration position at the track recorded by the control circuitry is between the first predetermined range and a second predetermined range, the control circuitry will calibrate the position of the carriage after the medium is printed.

8. The printer of claim 7 wherein when printing the medium, if the difference between the position of the second portion corresponding to the track recorded by the counter and the position of the calibration position at the track recorded by the control circuitry is greater than the second predetermined range, the control circuitry will instantly stop printing the medium to calibrate the position of the carriage.

9. The printer of claim 1 further comprising a step motor for driving the carriage wherein the counter counts rotational steps of the step motor to record the position of the second portion corresponding to the track.

10. The printer of claim 1 further comprising:

a DC motor for driving the carriage;

an optical ruler installed on the housing;

a light source installed on the carriage for emitting light toward the optical ruler; and a light sensor for detecting the light emitted by the light source through the optical ruler and generating corresponding position signals;

wherein the counter uses the position signals generated by the light sensor to record the position of the second portion corresponding to the track.

* * * * *